US006597387B1

(12) United States Patent
Chien

(10) Patent No.: US 6,597,387 B1
(45) **Date of Patent: *Jul. 22, 2003**

(54) THERMAL PRINTER AND METHOD FOR PRINTING STAMPABLE PICTURE

(75) Inventor: Hsu-Chu Chien, Taipei (TW)

(73) Assignee: Hi-Touch Imaging Technologies Co., Ltd., Pan Chiao (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/065,911

(22) Filed: Nov. 28, 2002

(51) Int. Cl.[7] ..... B41J 2/325
(52) U.S. Cl. ..... 347/212
(58) Field of Search ..... 347/172, 174, 347/176, 212, 217; 400/120.02, 120.04

(56) References Cited

U.S. PATENT DOCUMENTS 6,121,987 A * 9/2000 Sasaki et al. ..... 347/176
2002/0158960 A1 * 10/2002 Kasperchik et al. ..... 347/213

* cited by examiner

*Primary Examiner*—Huan Tran
(74) *Attorney, Agent, or Firm*—Winston Hsu

(57) ABSTRACT

A thermal printer includes a printer body, a thermal printhead installed in the printer body, a print ribbon installed in the printer body, and a control circuit for controlling the thermal printhead and the print ribbon. The print ribbon has regions of colored dye, regions of resistant overcoating, and regions of stampable overcoating capable of accepting an ink stamp. The print ribbon can be supplied as two exchangeable ribbons, one having colored dye and regions of resistant overcoating, the other having regions of stampable overcoating. The control circuit controls the thermal printhead and the print ribbon to print pictures having stampable images. An ink stamp can be externally applied to a stampable overcoating layer of the picture, an intermediate resistant overcoating layer protecting the image from damage.

13 Claims, 6 Drawing Sheets

THERMAL PRINTER AND METHOD FOR PRINTING STAMPABLE PICTURE

BACKGROUND OF INVENTION

1. Field of the Invention

The present invention relates to an electronic printer, and more specifically, to a thermal printer and related method for printing pictures having a stampable surface.

2. Description of the Prior Art

Thermal printers are used in computer systems to print digital images. One type of printer uses a printhead to heat a dye ribbon to transfer dye of different colors to a print medium. A typical dye ribbon comprises dye regions or frames of colors that can be printed in proportions to approximate true color, and a transparent overcoating region that can be disposed over printed dye to protect the printed dye from moisture degradation. Currently, this type of thermal printer is commonly used to print digital photographs via direct connection to a personal computer or digital camera.

As mentioned, the overcoating used is a water or oil resistant overcoating that protects the printed ink from running, fading, and smudging due to contact with moisture, water, and oil from handling. The resistant overcoating is disposed onto a printed picture by heat output from the thermal printhead in much the same way as the colored dye.

In many applications, it is desirable to be able to apply a traditional ink stamp to a photograph. Whether for official documentation, copyrighting, or forgery protection, users may want to apply an ink stamp, such as a seal or official identification stamp, to a picture printed by a digital thermal printer. However, the physical properties of the water or oil resistant overcoating are such that it does not take an externally applied stamp well. On the contrary, the resistant properties act against allowing an ink stamp to be applied to the overcoating resulting in a semi-permanent stamp or a stamp that is easily smudged or even completely removable. One method of avoiding this result is to use a permeable overcoating to allow the stamp ink to transfer to the print medium having the disposed printing dye. However, this practice is found to be inadequate, as it does not prevent other sources of moisture from entering the print and degrading the image.

Please refer to FIG. 6 showing a cross-section of a thermally printed picture 60. The picture 60 includes a print medium (paper) 62 having thermally printed dye layers 64*y*, 64*m*, and 64*c* respectively for yellow, magenta, and cyan dye protected by a permeable overcoating layer 68. The dye layers 64*y*, 64*m*, and 64*c* and overcoating layer 68 are printed to the paper 62 by a thermal printer. When a water based ink stamp is applied externally to the picture 60, water 72 from the ink penetrates the permeable overcoating 68 and acts to dissolve dye of the layers 64*y*, 64*m*, and 64*c* degrading the image. Consequently, this approach does not fully protect the printed image from damage.

SUMMARY OF INVENTION

It is therefore a primary objective of the claimed invention to provide a thermal printer capable of printing resistant and stampable overcoating and a related method for printing an image to solve the abovementioned problem.

Briefly summarized, the claimed invention includes a printer body, a thermal printhead installed in the printer body, a print ribbon installed in the printer body, and a control circuit for controlling the thermal printhead and the print ribbon. The print ribbon has regions of colored dye, regions of ink stamp vehicle resistant overcoating, and regions of stampable overcoating capable of accepting an ink stamp. A sensor is provided to detect the print ribbon and output a ribbon signal. The control circuit is capable of receiving the ribbon signal and controlling the thermal printhead and the print ribbon according to received image signals to print pictures having stampable images.

According the claimed invention, the print ribbon can be provided as two print ribbons, one print ribbon having regions of colored dye and regions of resistant overcoating, the other print ribbon having regions of stampable overcoating capable of accepting an ink stamp, both print ribbons being interchangeably installable in the printer body. And, the sensor is capable of detecting and distinguishing between the two print ribbons and outputting a corresponding ribbon signal.

According to the claimed invention, a method for printing an image with a thermal printer includes printing an image to a print medium by disposing colored dye onto the print medium, printing resistant overcoating over the image printed on the print medium, and printing stampable overcoating over the resistant overcoating.

It is an advantage of the claimed invention that stampable overcoating is applied over the resistant overcoating by the thermal printer so that ink stamps can be applied to the stampable overcoating while being prevented from damaging the image by the resistant overcoating.

It is a further advantage of the claimed invention that an ink stamp applied to a picture printed with the claimed invention is not easily smeared and does not degrade the image on the picture.

It is a further advantage of the claimed invention that the sensor can detect an installed print ribbon and set parameters thermal printhead parameters automatically.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
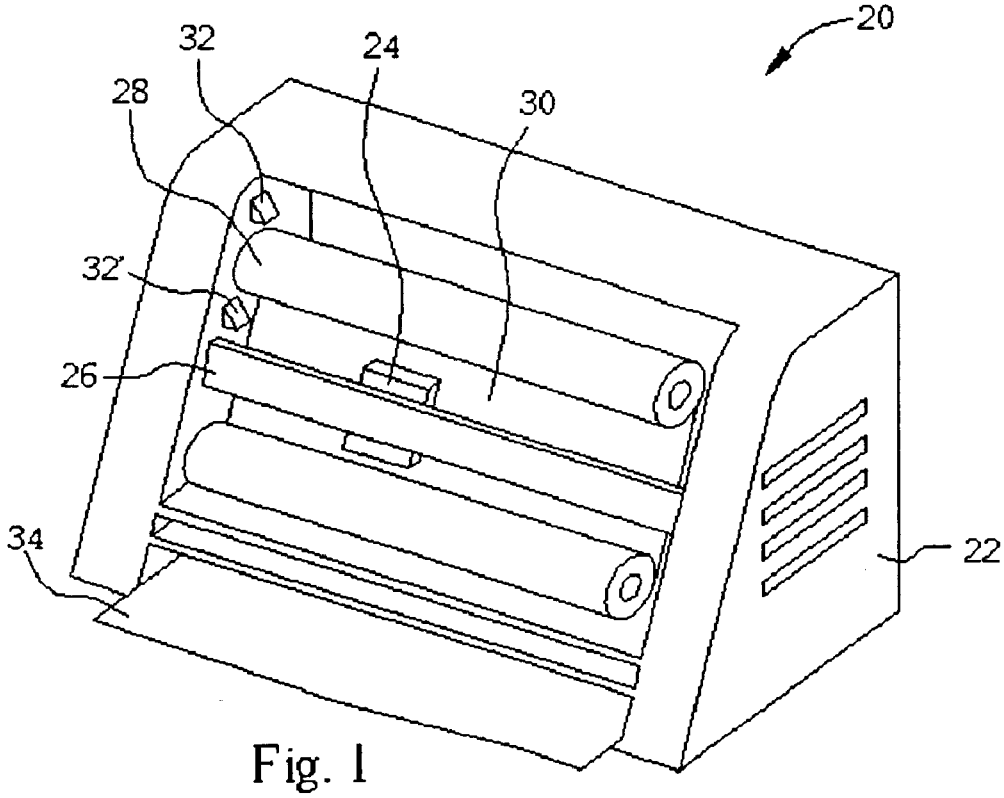
FIG. 1 is a perspective view of a thermal printer according to the present invention.

A digital thermal printer 20 according to the present invention is shown in FIG. 1. The thermal printer 20 includes a printer body 22, a thermal printhead 24 mounted on a track 26 attached to the body 22, and a removable ribbon cassette 28 installed in the printer body 22 having a spooled dye ribbon 30. The printer 20 further includes motors and related electronics (not shown) for driving the printhead 24 along the track 26 and the ribbon 30 in the ribbon cassette 28, and a control circuit (not shown) that controls the printhead 24 and the ribbon cassette 28. The control circuit receives image signals from a connected device such as a computer or digital camera and controls the printhead 24 and the ribbon cassette 28 to print corresponding images to a print medium 34 such as paper. A sensor 32 is provided for detecting the type of ribbon cassette 28 installed in the printer 20. The sensor 32 outputs a signal to the control circuit indicating the type of ribbon cassette 28 detected so that the control circuit can set related parameters and control the thermal printhead 24 to print images to the paper 34.

The sensor 32 can be a photosensor designed to detect a marking on the ribbon cassette 28 for identifying the type of ribbon 30 in the cassette. Other sensor designs that are well known in the art (such as the system used to identify film in automatic cameras) can also be used provided they are able to identify a marking on the ribbon cassette 28 and output an electrical signal such as a voltage or current to the control circuit. Moreover, a sensor 32" is included to replace or complement the sensor 32. The sensor 32" detects the ribbon 30 and determines which frame, and thereby which color of dyed region or overcoating, is currently under the printhead 24. Output of the sensor 32" can also be used by the control circuit to identify the type of ribbon 30, provided that there is a suitable marking on the ribbon 30 to trigger the sensor 32" or that ribbon is fed past the sensor 32" so that a sequence of dye and overcoating regions can be detected. The key difference between the sensors 32 and 32" is that the sensor 32 can indicate to the control circuit the type of ribbon 30 immediately upon installation of the ribbon 30, while the sensor 32" can only indicate the type of dye or overcoating region under the sensor 32" leaving extrapolation of this information to the control circuit to determine the type of ribbon 30. In the preferred embodiment, the sensor 32 is used to identify the type of ribbon 30 in the cassette 28, while the sensor 32" is used to detect transitions between the frames of the ribbon 30. Both sensors 32 and 32" output corresponding signals to the control circuit so that the control circuit can set parameters of the thermal printer 20 accordingly. Furthermore, the control circuit must be preprogrammed with possible ribbon cassette types and ribbon frame types in order for the sensing signals to be properly interpreted.

Figure 2A:
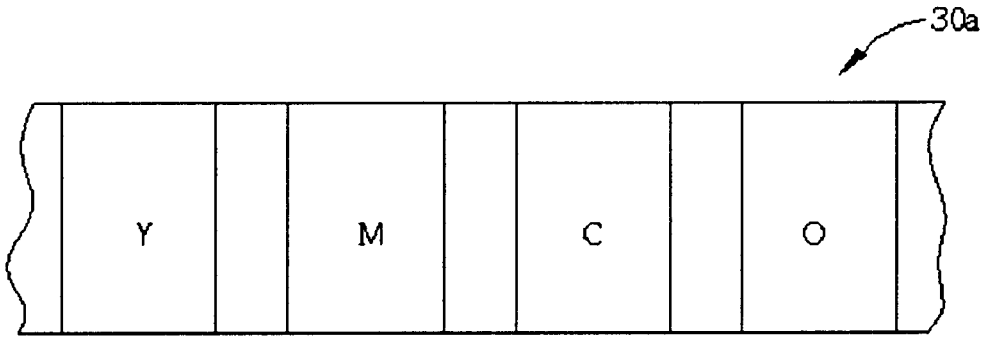
FIG. 2A is a schematic diagram of a YMC dye-overcoating print ribbon.

Referring to FIG. 2A, a dye-overcoating ribbon 30*a* is illustrated. The ribbon 30*a* has a repeating sequence of regions (the 4 shown being representative) having dye of colors yellow Y, magenta M, cyan C, and transparent overcoating O. The regions are separated by areas (that can be dyed black), which can be used for transition detection if necessary. The overcoating provided in the region O is a water or oil resistant or waterproof overcoating (or generally, an overcoating that is resistant to the vehicle used in the ink stamps to be expected). The ribbon 30*a* is installed in a ribbon cassette that can be identified by the sensor 32. When the ribbon cassette containing the ribbon 30*a* is installed into the printer 20, the sensor 32 detects that the ribbon present is a YMC-dye overcoating ribbon.

Figure 2B:
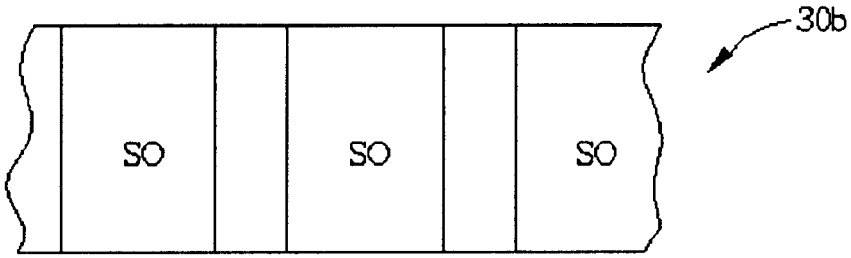
FIG. 2B is a schematic diagram of a stampable overcoating print ribbon according to the present invention.

FIG. 2B shows a stampable overcoating print ribbon 30*b* exclusively having frames of stampable overcoating SO. The stampable overcoating is conducive to receiving an externally applied ink stamp. Again, the regions of stampable overcoating SO are separated by areas that can be used for detecting transitions between regions to prevent exhausted frames from being reused. Alternatively, a single continuous region of stampable overcoating could be used, the printer 20 being set to not rewind the ribbon to the portion already used. When a ribbon cassette containing the ribbon 30*b* is installed in the printer 20, the sensor 32 detects that the ribbon present is a stampable overcoating ribbon.

Figure 4:
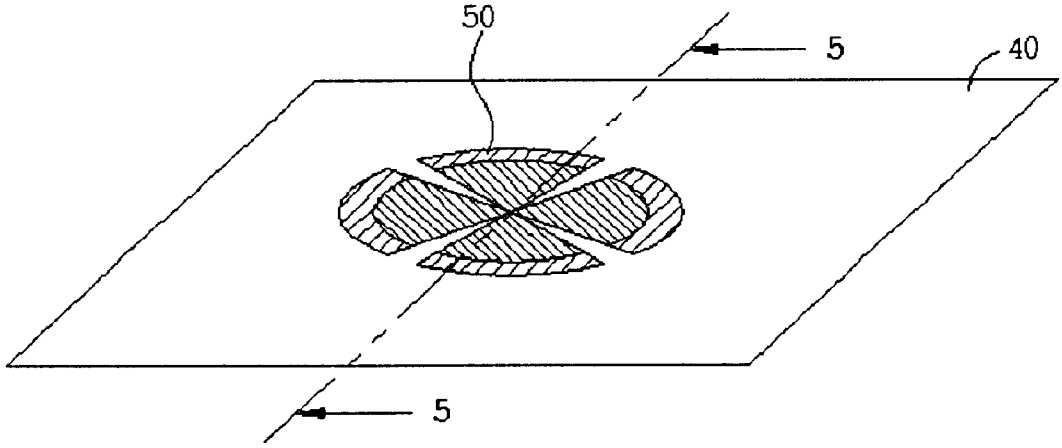
FIG. 4 is a perspective view of an ink stamped picture printed by the printer of FIG. 1.

The print ribbons 30*a* and 30*b* are used in conjunction to print a stampable picture 40 shown in FIG. 4. First, the cassette containing the ribbon 30*a* is installed into the printer 20. The sensor 32 detects that the ribbon 30*a* is a YMC-dye overcoating ribbon and outputs a corresponding signal to the control circuit. The control circuit sets printing parameters such as printhead speed, ribbon feed speed, and printhead power and controls the printing process. After the image is printed and overcoated with resistant overcoating, a user removes the cassette containing the ribbon 30*a* and replaces it with the cassette containing the ribbon 30*b*. The sensor 32 detects that the ribbon 30*b* is a stampable overcoating ribbon and the control circuit sets printing parameters accordingly. Lastly, the printer 20 prints stampable overcoating over the resistant overcoating to complete printing the stampable picture 40. At a later time, an ink stamp 50 can be applied, typically in a manual way, as shown in FIG. 4.

Figure 5:
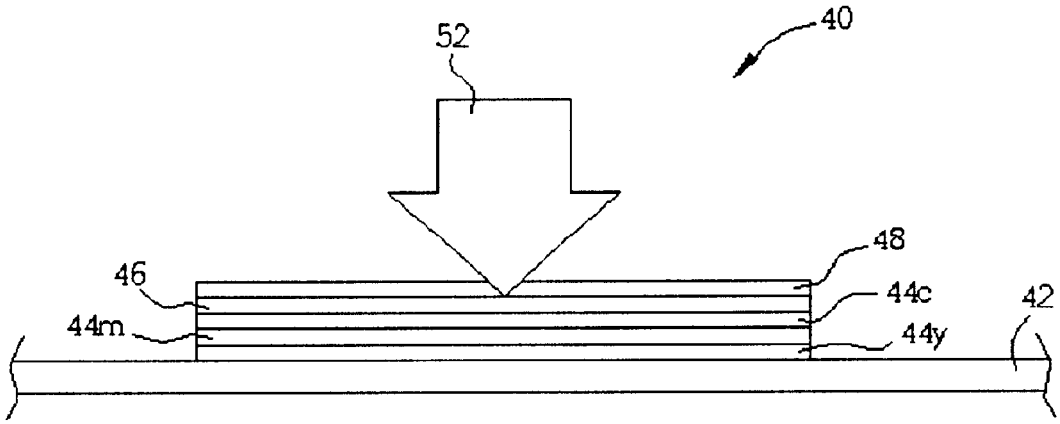
FIG. 5 is a cross-sectional view of a stampable printed picture of FIG. 4.
Figure 6:
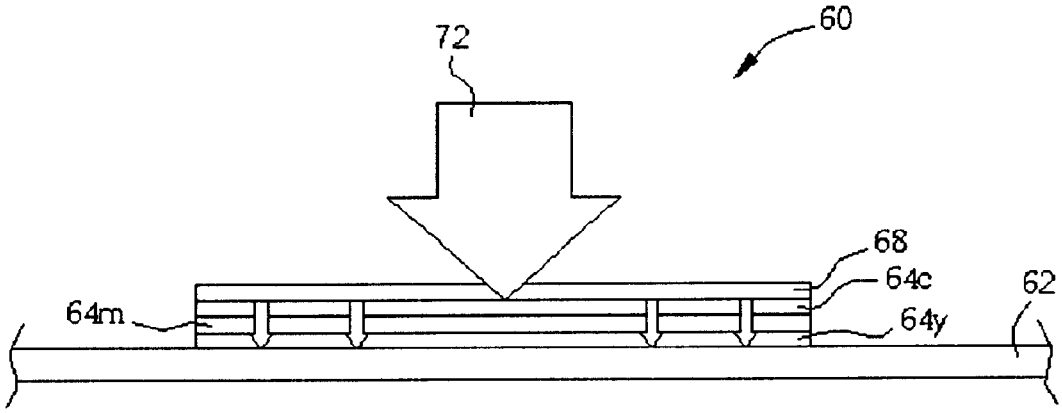
Fig. 6 Prior art
FIG. 6 is a cross-sectional view of a prior art stampable printed picture.

A cross-sectional view of the picture 40 along line 5–5 is shown in FIG. 5. The picture 40 includes a print medium 42 such as paper and printed dye layers 44*y*, 44*m*, and 44*c* respectively for yellow, magenta, and cyan dye. Disposed over of the printed dye layers is a resistant overcoating layer 46, and over that is a stampable overcoating layer 48. The configuration of the layers 44–48 prevents water 52 from the externally applied ink stamp 50 from coming into contact with the dye layers 44*y*, 44*m*, and 44*c*. The water 52 is absorbed by the stampable overcoating layer 48 and prevented from entering the dye layers 44*y*, 44*m*, and 44*c* by the water resistant overcoating layer 46. Thus, the present invention prevents damage to the image while providing a suitable stampable surface.

Figure 3:
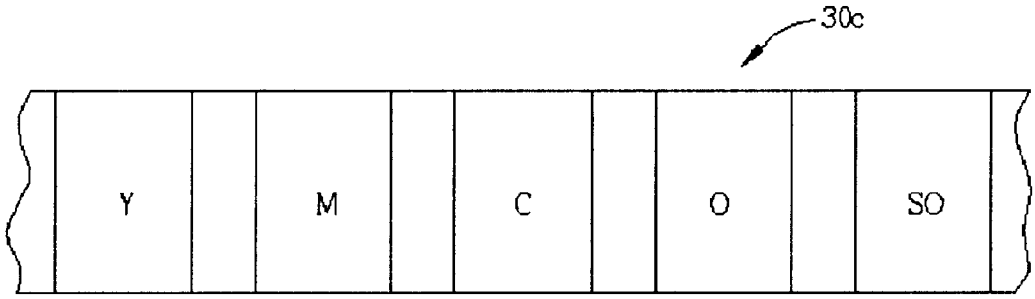
FIG. 3 is a schematic diagram of a YMC dye-overcoating-stampable overcoating print ribbon according to the present invention.

FIG. 3 shows another print ribbon 30*c* according to the present invention. The ribbon 30*c* has a repeating sequence of regions (the 5 shown being representative) having dye of colors yellow Y, magenta M, cyan C, transparent overcoating O, and stampable overcoating SO. The regions are separated by areas (that can be dyed black), which can be used for transition detection if necessary. The overcoating provided in the region O is a water or oil resistant or waterproof overcoating, while the stampable overcoating SO can readily accept an externally applied ink stamp. The ribbon 30*c* is installed in a ribbon cassette that can be identified by the sensor 32. When the ribbon cassette containing the ribbon 30*c* is installed into the printer 20, the sensor 32 detects that the ribbon present is a YMC dye-overcoating-stampable overcoating print ribbon.

The ribbon 30*c* can be used to print the picture 40 shown in FIG. 4 and FIG. 5 in much the same way as the ribbons 30*a* and 30*b*. One advantage that the ribbon 30*c* has over the ribbons 30*a* and 30*b* is that ribbon exchange is unnecessary, as all required printing dye and overcoating in present in the ribbon 30*c*. However, the interchangeable ribbons 30*a* and 30*b* have the advantage of conserving stampable overcoating frames. In other words, all pictures printed with the ribbon 30*c* should employ stampable overcoating to minimize waste. As a result, the ribbon 30*c* is suitable for commercial users who print numerous pictures that may later require ink stamps, while ribbons 30*a* and 30*b* are better suited for a home user or a casual user who requires more flexibility and may not require stampable overcoating on every picture.

In the above description, the printer 20 printed stampable overcoating to the entire picture. However, the printer 20 can also print stampable overcoating to specific regions of the picture where it is expected that ink stamps will be applied. Accordingly, the control circuit can be configured by a user to only print stampable overcoating to specific regions of the picture.

In other embodiments of the present invention the sensors 32 and 32" for detecting the type of print ribbon may be excluded. For instance, if a thermal printer is designed for only a single type of ribbon, a ribbon cassette detecting sensor becomes redundant. It should also be noted that while stampable and resistant overcoating for a water based ink stamp was described, properties of both the stampable and resistant overcoating can be selected to match another type of stamp, such as an oil based stamp. However, the resistant overcoating should still retain properties to protect the printed image from accidental contact with other sources of moisture, water, oil, etc. That is, the present invention in not limited by the vehicle of the external stamp being applied.

In contrast to the prior art, the present invention thermal printer prints a picture having a stampable surface that is isolated from a printed image. Print ribbons according to the present invention provide both resistant overcoating and stampable overcoating to the thermal printer. The thermal printer disposes an intermediate resistant overcoating layer over a printed image and a stampable overcoating layer over the resistant overcoating layer. The vehicle (water, oil, etc) of an ink stamp applied to the stampable surface of the printed picture is prevented from contacting dye forming the printed image by the intermediate resistant overcoating layer. Thus, the printer and method of the present invention can be used to generate ink stampable pictures resistant to damage by the ink stamp.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A thermal printer comprising:

a printer body;

a thermal printhead installed in the printer body;

a first print ribbon installed in the printer body, the first print ribbon comprising regions of colored dye, regions of resistant overcoating resistant to an ink stamp vehicle, and regions of stampable overcoating capable of accepting the ink stamp; and a control circuit for controlling the thermal printhead and the first print ribbon;

wherein according to instructions from the control circuit, the thermal printhead is capable of printing an image to a print medium by heating regions of colored dye, disposing resistant overcoating over the printed image by heating a resistant overcoating region, and disposing stampable overcoating over the resistant overcoating by heating a stampable overcoating region.

2. The thermal printer of claim 1 wherein the first print ribbon in spooled in a ribbon cassette, and the regions of colored dye, resistant overcoating, and stampable overcoating are disposed on the first print ribbon in a repeating sequence of yellow dye, magenta dye, cyan dye, resistant overcoating, and stampable overcoating.

3. The thermal printer of claim 1 further comprising a sensor capable of detecting the regions of colored dye, resistant overcoating, and stampable overcoating and outputting a corresponding ribbon signal indicating the region detected to the control circuit, the control circuit setting printing parameters for the printhead based on the ribbon signal.

4. A thermal printer comprising:

a printer body;

a thermal printhead installed in the printer body;

a second print ribbon installed in the printer body, the second print ribbon comprising regions of colored dye and regions of resistant overcoating resistant to an ink stamp vehicle;

a third print ribbon capable of being installed in the printer body, the third print ribbon comprising regions of stampable overcoating capable of accepting the ink stamp; wherein the second print ribbon and the third print ribbon are interchangeable;

a sensor installed in the printer body for detecting a print ribbon and outputting a ribbon signal; and a control circuit for receiving the ribbon signal and setting parameters of the thermal printhead accordingly, and for controlling the thermal printhead and the installed print ribbon;

wherein according to instructions from the control circuit, when the second print ribbon is installed in the printer body, the thermal printhead is capable of printing an image to a print medium by heating regions of colored dye, and disposing resistant overcoating over the printed image by heating a resistant overcoating region; and when the third print ribbon is installed in the printer body, the thermal printhead is capable of printing stampable overcoating over the resistant overcoating by heating a stampable overcoating region.

5. The thermal printer of claim 4 wherein the regions of colored dye and resistant overcoating are disposed on the second print ribbon in a repeating sequence of yellow dye, magenta dye, cyan dye, and resistant overcoating.

6. The thermal printer of claim 4 wherein the second and third print ribbons are spooled in ribbon cassettes.

7. The thermal printer of claim 6 wherein the sensor is capable of detecting the second print ribbon cassette and the third print ribbon cassette and outputting a corresponding ribbon signal indicating the ribbon cassette detected.

8. The thermal printer of claim 7 wherein the sensor is further capable of detecting a first ribbon cassette having a first print ribbon spooled therein, the first print ribbon comprising regions of colored dye, regions of resistant overcoating, and regions of stampable overcoating, the sensor further capable of outputting a corresponding ribbon signal.

9. The thermal printer of claim 4 wherein the sensor is capable of detecting the regions of colored dye, resistant overcoating, and stampable overcoating and outputting a corresponding ribbon signal indicating the region detected.

10. A method for printing an image with a thermal printer, the method comprising:

providing a print medium;

printing an image to the print medium with the thermal printer by disposing colored dye onto the print medium;

printing resistant overcoating over the image printed on the print medium with the thermal printer, wherein the resistant overcoating is resistant to an ink stamp vehicle; and printing stampable overcoating over the resistant overcoating with the thermal printer, wherein the stampable overcoating is capable of accepting the ink stamp.

11. The method of claim 10 wherein the resistant overcoating is printed to cover the entire area of the print medium, and the stampable overcoating is printed to cover only a portion of the print medium.

12. The method of claim 10 wherein both the resistant overcoating and the stampable overcoating are printed to cover the entire area of the print medium.

13. The method of claim 10 wherein the thermal printer comprises a printer body, a thermal printhead, at least a print ribbon, and a control circuit for controlling the thermal printhead and the print ribbon.

* * * * *